US009864314B2

(12) United States Patent
Ninomiya et al.

(10) Patent No.: US 9,864,314 B2
(45) Date of Patent: Jan. 9, 2018

(54) IMAGE FORMING APPARATUS

(71) Applicant: FUJI XEROX CO., LTD., Tokyo (JP)

(72) Inventors: Yosuke Ninomiya, Kanagawa (JP); Takuji Matsumoto, Kanagawa (JP); Jun Sawamura, Kanagawa (JP); Takayuki Ukawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/044,765

(22) Filed: Feb. 16, 2016

(65) Prior Publication Data

US 2017/0052475 A1 Feb. 23, 2017

(30) Foreign Application Priority Data

Aug. 17, 2015 (JP) ..... 2015-160380

(51) Int. Cl.
*G03G 15/20* (2006.01)
*G03G 21/16* (2006.01)
*G03G 15/08* (2006.01)

(52) U.S. Cl.
CPC ..... *G03G 15/2067* (2013.01); *G03G 15/0868* (2013.01); *G03G 15/2064* (2013.01); *G03G 21/1647* (2013.01); *G03G 15/0872* (2013.01); *G03G 15/2032* (2013.01); *G03G 2221/1657* (2013.01)

(58) Field of Classification Search
CPC ..... G03G 15/2032; G03G 15/2035; G03G 15/2067; G03G 15/2071
USPC ..... 399/320
See application file for complete search history.

(56) References Cited

U.S. PATENT DOCUMENTS 3,826,892 A * 7/1974 Draugelis ..... G03G 15/2007 219/216
6,019,363 A * 2/2000 Ahn ..... H04N 1/0402 271/10.05

(Continued)

FOREIGN PATENT DOCUMENTS

JP 2004-317811 A 11/2004
JP 2004317811 A * 11/2004

(Continued)

*Primary Examiner* — Carla Therrien
(74) *Attorney, Agent, or Firm* — Oliff PLC

(57) ABSTRACT

An image forming apparatus includes an image forming unit, a developer replenishing device, a fixing device, a press-contact adjustment mechanism, first and second driving transmission mechanisms, and a driving switching mechanism. The image forming unit forms a developer image on a recording medium. The developer replenishing device and the fixing device are detachable. The developer replenishing device replenishes a developer. The fixing device includes first and second rotation members. The second rotation member faces the first rotation member. The fixing device fixes the developer image to the recording medium. The press-contact adjustment mechanism adjusts a press-contact state between the first and second rotation members. The first driving transmission mechanism transmits a driving force to the press-contact adjustment mechanism. The second driving transmission mechanism transmits a driving force to the developer replenishing device. The driving switching mechanism couples the driving source to the first or second driving transmission mechanism.

6 Claims, 10 Drawing Sheets

(56) References Cited

U.S. PATENT DOCUMENTS

| | | | | |
|---|---|---|---|---|
| 6,446,556 | B1 * | 9/2002 | Ida | G03G 15/50 101/484 |
| 7,734,202 | B2 * | 6/2010 | Lee | G03G 15/2032 399/124 |
| 9,354,560 | B2 * | 5/2016 | Imaizumi | G03G 21/1647 |
| 2007/0280743 | A1 * | 12/2007 | Nakajima | G03G 15/0865 399/262 |
| 2010/0021208 | A1 * | 1/2010 | Tomatsu | G03G 15/757 399/222 |
| 2015/0037071 | A1 * | 2/2015 | Yamamoto | G03G 15/0879 399/258 |
| 2016/0010734 | A1 * | 1/2016 | Tokoro | B65H 3/0669 74/405 |

FOREIGN PATENT DOCUMENTS

| | | | | |
|---|---|---|---|---|
| JP | 2010-139732 | A | | 6/2010 |
| JP | 2010139732 | A | * | 6/2010 |
| JP | 2014-089358 | A | | 5/2014 |
| JP | 2014089358 | A | * | 5/2014 |

* cited by examiner

IMAGE FORMING APPARATUS

CROSS-REFERENCE TO RELATED APPLICATIONS

This application is based on and claims priority under 35 USC 119 from Japanese Patent Application No. 2015-160380 filed Aug. 17, 2015.

BACKGROUND

Technical Field

The present invention relates to an image forming apparatus.

SUMMARY

According to an aspect of the invention, an image forming apparatus includes an image forming unit, a developer replenishing device, a fixing device, a press-contact adjustment mechanism, a first driving transmission mechanism, a second driving transmission mechanism, and a driving switching mechanism. The image forming unit forms a developer image on a recording medium. The developer replenishing device is detachable from an image forming apparatus body and replenishes a developer to the image forming unit. The fixing device is detachable from the image forming apparatus body. The fixing device includes a first rotation member and a second rotation member. The second rotation member faces the first rotation member. The fixing device fixes the developer image formed by the image forming unit to the recording medium. The press-contact adjustment mechanism adjusts a press-contact state between the first rotation member and the second rotation member. The first driving transmission mechanism transmits a driving force to the press-contact adjustment mechanism. The second driving transmission mechanism transmits a driving force to the developer replenishing device. The driving switching mechanism couples the driving source to the first driving transmission mechanism or the second driving transmission mechanism.

BRIEF DESCRIPTION OF THE DRAWINGS

Exemplary embodiments of the present invention will be described in detail based on the following figures, wherein:

FIG. 6A is a diagram illustrating the fixing device when a developer image is fixed on plain paper, FIG. 6B is a diagram illustrating the fixing device when a developer image is fixed on an envelope, and FIG. 6C is a diagram illustrating the fixing device in a state where the force for pushing a first rotation member and a second rotation member on each other is released;

DETAILED DESCRIPTION

Figure 1:
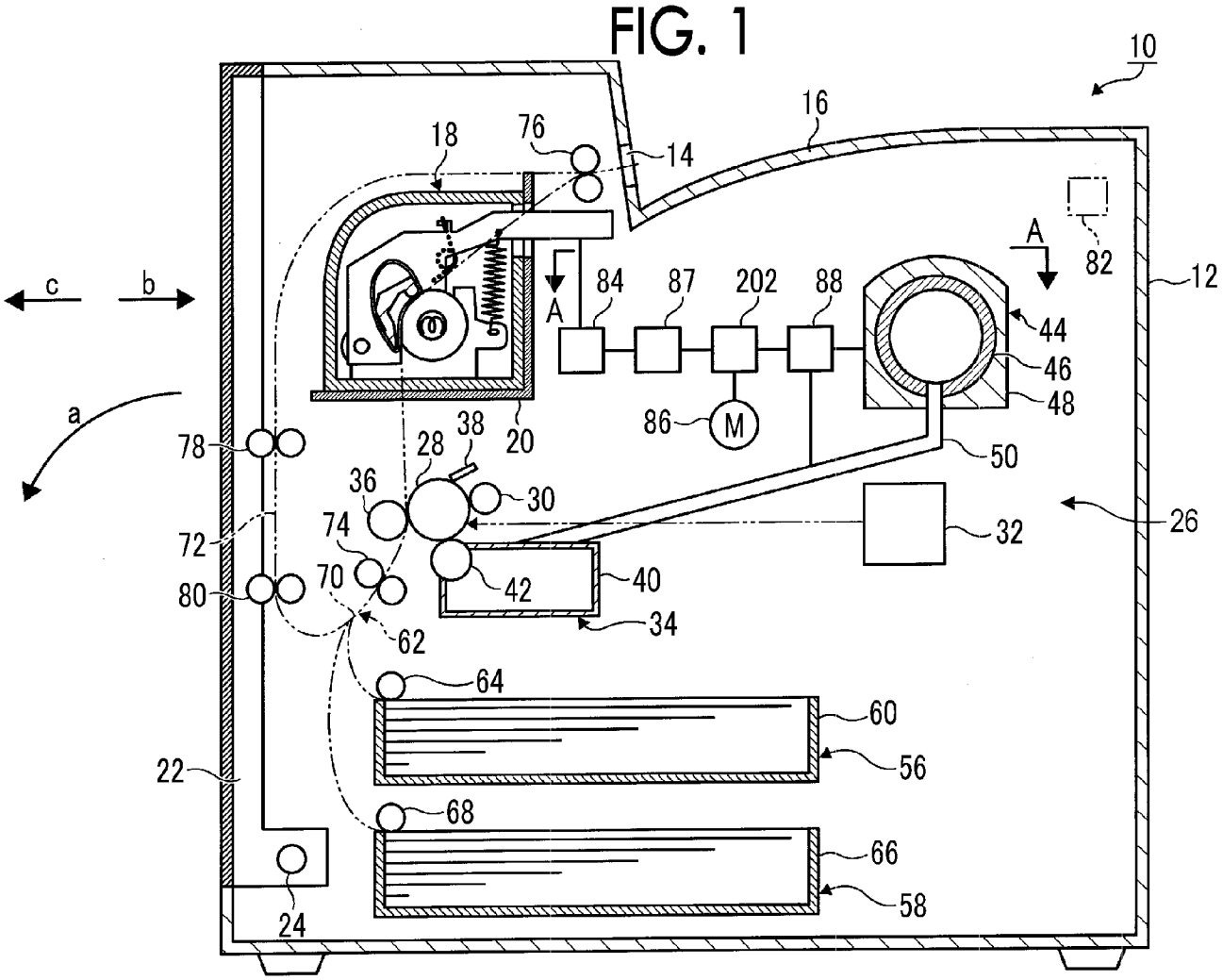
FIG. 1 is a diagram illustrating a schematic configuration of an image forming apparatus according to an exemplary embodiment of the invention.

Hereinafter, a form for embodying the present invention will be described with reference to the accompanying drawings. FIG. 1 illustrates an image forming apparatus 10 according to an exemplary embodiment of the invention. As illustrated in FIG. 1, the image forming apparatus 10 includes an image forming apparatus body 12. The image forming apparatus body 12 is formed with an output port 14. The output port 14 outputs paper which is used as a recording medium. A surface on an upper side of the image forming apparatus body 12 is used as an output unit 16 to which a recording medium having a developer image fixed thereon is output. Here, the recording medium corresponds to a member on which recording is performed by fixing a developer image. A specific example of the recording medium may include plain paper, an envelope, and the like.

The image forming apparatus body 12 includes a tie-plate 20 used as a unit to be fixed to which a fixing device 18 (which will be described later) is fixed. Fixation to the tie-plate 20 causes the fixing device 18 to be accurately positioned in the image forming apparatus body 12, and the fixing device 18 is reinforced.

An opening and closing unit 22 is mounted on the left side of the image forming apparatus body 12 (left side in FIG. 1) such that the opening and closing unit 22 may be opened or closed with respect to the image forming apparatus body 12 by rotation with a hinge 24 as the center. FIG. 1 illustrates a state where the opening and closing unit 22 is closed with respect to the image forming apparatus body 12. The opening and closing unit 22 is moved from the state illustrated in FIG. 1, so as to be rotated with the hinge 24 as the center, in a direction indicated by an arrow as illustrated in FIG. 1. Thus, the opening and closing unit 22 is in opened with respect to the image forming apparatus body.

An image forming unit 26 that forms a developer image on paper is disposed in the image forming apparatus body 12. The image forming unit 26 includes a photosensitive drum 28, a charging device 30, a latent image forming device 32, a developing device 34, a transfer device 36, and a cleaning device 38. The photosensitive drum 28 is used as an image holding member that holds an image. The charging device 30 uniformly charges a surface of the photosensitive drum 28. The latent image forming device 32 forms an electrostatic latent image on the surface of the photosensitive member, which is uniformly charged by the charging device 30. The developing device 34 develops a latent image which is formed by the latent image forming device 32, by using a developer. The transfer device 36 transfers a developer image which is formed on the surface of the photosensitive drum 28 by the developing device 34 developing the latent image, to paper. The cleaning device 38 removes the developer and the like remaining on the surface of the photosensitive drum 28 after the developer image is transferred by the transfer device 36.

All or some of the photosensitive drum 28, the charging device 30, the latent image forming device 32, the developing device 34, and the cleaning device 38 may be stored in one structural member. This structural member may be used as a so-called process cartridge and this process cartridge may be detachable from the image forming apparatus body 12.

The developing device 34 includes a developing device body 40 and a developing roll 42. The developing roll 42 holds a developer and supplies the developer to the photosensitive drum 28. In this exemplary embodiment, a so-called two-component developing device is used as the developing device 34. The developing device 34 develops a latent image by using a two-component developer which is formed of a non-magnetic toner and a magnetic carrier. More specifically, a charged toner in the developer is electrostatically moved to the photosensitive drum 28 and thus, the developing device 34 develops a latent image.

A toner replenishing device 44 is disposed as a developer replenishing device, in the image forming apparatus body 12. The toner replenishing device 44 is a device that replenishes a toner to the developing device 34 when the concentration of the toner in the developer which is stored in the developing device body 40 is lowered, for example. The toner replenishing device 44 includes a toner storing vessel 46, a toner replenishing device body 48, and a transporting path 50. The toner storing vessel 46 stores the toner. The toner storing vessel 46 is detachably attached to the toner replenishing device body 48. The transporting path 50 is used for transporting the toner to the developing device 34. For example, a toner transporting member (not illustrated) that transports the toner by rotation thereof is disposed on the transporting path 50.

The fixing device 18 that fixes a developer image which is formed on paper by the image forming unit 26, to the paper is disposed in the image forming apparatus body 12. The fixing device 18 is detachably attached to from the image forming apparatus body 12. In a state where the fixing device 18 is mounted in the image forming apparatus body 12, the fixing device 18 is fixed to the tie-plate 20.

To mount the fixing device 18 in the image forming apparatus body 12, the opening and closing unit 22 is opened with respect to the image forming apparatus body 12, and an operator inserts the fixing device 18 into the image forming apparatus body 12 from the outside of the image forming apparatus body 12 toward the tie-plate 20 in a direction indicated by an arrow b illustrated in FIG. 1. To detach the fixing device 18 from the image forming apparatus body 12, the opening and closing unit 22 is opened with respect to the image forming apparatus body 12, and the fixing device 18 fixed to the tie-plate 20 is pulled out of the image forming apparatus body 12 in a direction indicated by an arrow c illustrated in FIG. 1.

Attaching or detaching of the fixing device 18 to or from the image forming apparatus body 12 is performed, for example, when the fixing device 18 which has been used thus far is replaced with another fixing device 18. The replacement of the fixing device occurs due to, for example, a case where a fixing roll 52 or a fixing belt 54 which will be described later is deteriorated by use of the fixing roll 52 or the fixing belt 54. Details of the fixing device 18 will be described later.

A sheet feeding device 56 and a sheet feeding device 58 are disposed in the image forming apparatus body 12. The sheet feeding device 56 feeds, for example, paper such as plain paper, or an envelope (referred to as paper and the like below) to the image forming unit 26. The sheet feeding device 58 similarly feeds paper and the like to the image forming unit 26. The sheet feeding device 56 includes a paper storing unit 60 and a sending device 64. The paper storing unit 60 stores paper and the like in a state where the paper and the like are laminated. The sending device 64 sends the paper and the like stored in the paper storing unit 60 to a transporting path 62 (which will be described later). The sheet feeding device 58 includes a paper storing unit 66 and a sending device 68. The paper storing unit 66 stores paper and the like in a state where the paper and the like are laminated. The sending device 68 sends the paper and the like stored in the paper storing unit 66 to the transporting path 62 (which will be described later).

Paper and the like stored in the paper storing unit 60 may be different in type or size from paper and the like stored in the paper storing unit 66. An example of the different type of paper and the like may include paper having a different thickness from each other. An example of paper and the like which are different from each other may include plain paper and an envelope. When a developer is fixed to sheets of paper which are different types, for example, different thicknesses, it is desirable that fixation conditions under which the fixing device 18 fixes a developer image to paper are set to be different from each other.

The transporting path 62 for transporting paper and the like is provided in the image forming apparatus body 12. The transporting path 62 includes a main transporting path 70 and a reversal transporting path 72. The above-described sheet feeding device 58, the above-described sheet feeding device 56, registration rolls 74, the above-described transfer device 36, the above-described photosensitive drum 28, the above-described fixing device 18, and output rolls 76 are disposed along the main transporting path 70 in an order from an upstream side in a transporting direction of paper and the like on the main transporting path 70.

The registration rolls 74 temporarily stop moving of a leading end portion of paper and the like which are fed from either of the sheet feeding device 56 and the sheet feeding device 58, and the registration rolls 74 restart moving of the leading end portion of the paper and the like to a transfer unit which is formed by the photosensitive drum 28 and the transfer device 36 such that a timing when the registration rolls 74 restart is matched with a timing when a toner image is formed on the surface of the photosensitive drum 28.

The transfer device 36 electrostatically transfers a toner image formed on the surface of the photosensitive drum 28 to which a transfer bias is applied, to paper and the like.

The output rolls 76 cause paper and the like to which a toner image is fixed by the fixing device 18 to pass through the output port 14, and thus, output the paper and the like to the output unit 16. When a developer image is formed on one side of paper and the like which has a developer image formed on another side thereof, reverse rotation of the output rolls 76 starts at a timing when the vicinity of a rear end portion of the paper and the like reaches the output roll 76. The output rolls 76 are rotated in a reverse direction and thus, the output rolls 76 send the paper and the like having a developer image formed on one side to the reversal transporting path 72 from the rear end portion side thereof.

For example, two transport rolls 78 and two transport rolls 80 are disposed along the reversal transporting path 72 in an order from an upstream side in the transporting direction of the paper and the like on the reversal transporting path 72. The transport rolls 78 and the transport rolls 80 transports paper to the registration rolls 74 in a state where the paper and the like having a toner image formed on one side thereof is reversed.

An operation panel 82 which is used as an operation unit for operating the image forming apparatus 10 is attached to, for example, the front side surface of the image forming apparatus body 12. The operation panel 82 is used for inputting information regarding image formation, for example, inputting which one of the sheet feeding device 56 and the sheet feeding device 58 feeds paper, by an operator.

A changing mechanism 84 and a motor 86 are disposed in the image forming apparatus body 12. The changing mechanism 84 is used as a press-contact adjustment mechanism that changes the force for causing the fixing roll 52 (which will be described later) and the fixing belt 54 (which will be described later) to push each other, so as to adjust a press-contact state. The motor 86 is used as a driving source that drives the changing mechanism 84. The changing mechanism 84 and the motor 86 are coupled to each other, for example, through a first driving transmission mechanism 87 (which will be described later) such as a gear train, and a swing gear 202 as a driving switching mechanism.

The motor 86 is also used as a driving source that drives the toner replenishing device 44. The toner replenishing device 44 and the motor 86 are coupled to each other, for example, through a second driving transmission mechanism 88 (which will be described later) such as a gear train, and the swing gear 202. The second driving transmission mechanism 88 is coupled to the motor 86 through the swing gear 202, and thus, drives a toner transporting member (not illustrated) in the toner replenishing device 44, and drives a toner transporting member (not illustrated) in the transporting path 50.

In this manner, the motor 86 that drives the changing mechanism 84 is also used as a driving source of a transporting member for agitating and transporting the toner in the toner replenishing device 44, and is also used as a driving source of a transporting member for transporting the toner to the developing device 34. The changing mechanism 84 that adjusts the press-contact state of the fixing device 18 and the toner replenishing device 44 that is intermittently driven share the driving source. Thus, productivity in image formation is ensured, and the number of components is reduced to the minimum.

Figure 2:
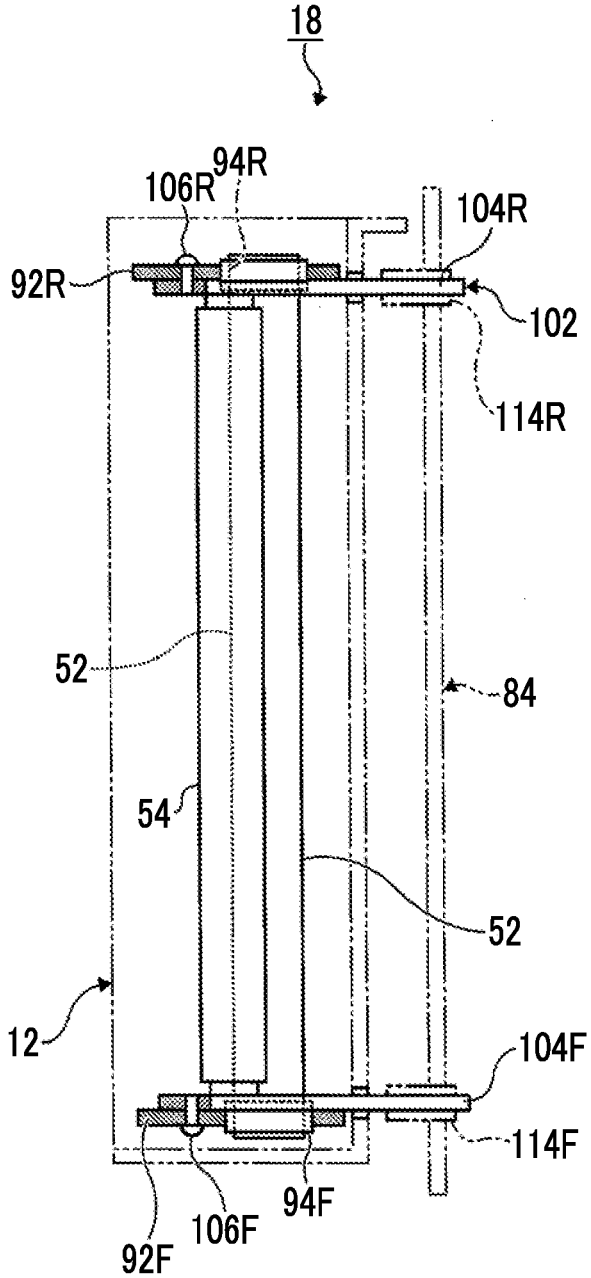
FIG. 2 is a plan view illustrating a fixing device provided in the image forming apparatus illustrated in FIG. 1.
Figure 3:
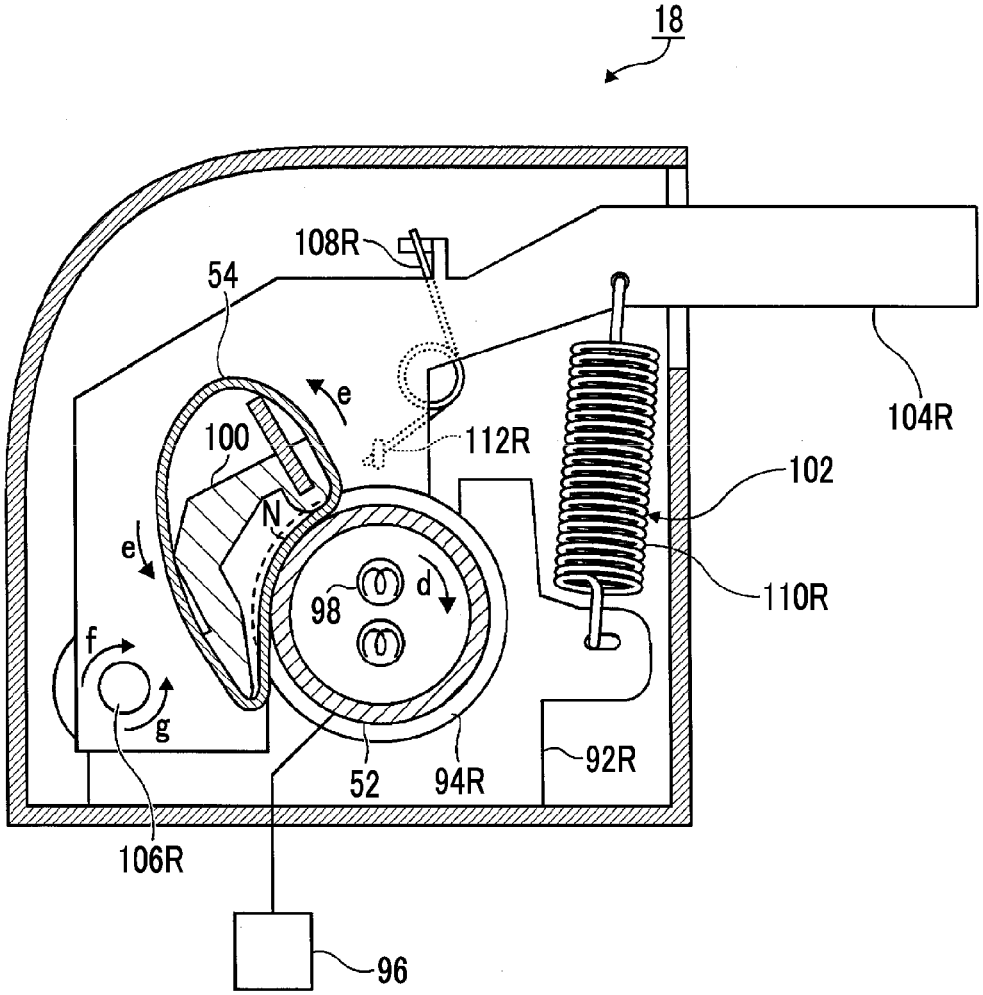
FIG. 3 is a vertical sectional view illustrating the fixing device illustrated in FIG. 2.

FIGS. 2 and 3 illustrate the fixing device 18. As illustrated in FIGS. 2 and 3, the fixing device 18 includes a rear side plate 92R which is a side plate positioned on the rear side, a front side plate 92F which is a side plate positioned on the front side, and a fixing roll 52 used as a first rotation member. The fixing roll 52 is supported such that the fixing roll 52 on the rear end portion side thereof may be rotated about the rear side plate 92R through a bearing 94R. In addition, the fixing roll 52 is supported such that the fixing roll 52 on the front end portion side thereof may be rotated about the front side plate 92F through a bearing 94F.

For example, a driving source 96 such as a motor is coupled to the fixing roll 52. The fixing roll 52 receives a driving force transmitted from the driving source 96 and may be rotated in a direction indicated by an arrow d illustrated in FIG. 3. The fixing roll 52 has a cylindrical shape and includes a heat source 98. The heat source 98 may use, for example, a halogen lamp and the like and is disposed in a hollow portion of the fixing roll 52.

The fixing device 18 includes the fixing belt 54. The fixing belt 54 comes into contact with the fixing roll 52 and is used as a second rotation member that forms a nip region N obtained by nipping paper between the fixing roll 52 and the fixing belt 54. The fixing belt 54 has flexibility and is a member having an endless belt shape. The fixing belt 54 is supported by a belt support unit 100 disposed in the fixing belt 54, so as to enable rotation. Rotation of the fixing roll 52 in the direction indicated by the arrow d drives the fixing belt 54 so that the fixing belt 54 rotates in a direction indicated by an arrow e illustrated in FIG. 3.

The fixing device 18 includes a pushing mechanism 102 which causes the fixing roll 52 and the fixing belt 54 to be pushed to each other. The pushing mechanism 102 includes a rear side lever member 104R, a front side lever member 104F, and the above-described belt support unit 100. Here, the rear side lever member 104R and the front side lever member 104F are used as moving members which move by an action of the changing mechanism 84 (see FIG. 1).

The rear side lever member 104R is supported so as to allow rotation about the rear side plate 92R by a rear side shaft member 106R. The front side lever member 104F is attached so as to allow rotation about the front side plate 92F by a front side shaft member 106F. The belt support unit 100 supports the fixing belt 54, and has a rear end portion which is fixed to the rear side lever member 104R, and a front end portion which is fixed to the front side lever member 104F.

With the above configuration, the belt support unit 100, the fixing belt 54, the rear side lever member 104R, and the front side lever member 104F may integrally be rotated and swing about the rear side plate 92R and the front side plate 92F in a direction indicated by an arrow f in FIG. 3 and in a direction indicated by an arrow g in FIG. 3, by using the rear side shaft member 106R and the front side shaft member 106F as the center.

The pushing mechanism 102 includes a torsion spring 108R used as a first urging unit and a torsion spring 108F (not illustrated) which is similarly used as the first urging unit. The pushing mechanism 102 includes a coil spring 110R as a second urging unit and a coil spring 110F (not illustrated) which is similarly used as the second urging unit. The torsion spring 108R, the torsion spring 108F, the coil spring 110R, and the coil spring 110F are members for pushing one of the fixing roll 52 and the fixing belt 54 to another of the fixing roll 52 and the fixing belt 54. In this exemplary embodiment, the torsion spring 108R, the torsion spring 108F, the coil spring 110R, and the coil spring 110F are used for pushing the fixing belt 54 to the fixing roll 52.

One end portion of the torsion spring 108R is coupled to the rear side lever member 104R and another end portion thereof is fixed to a fixation portion 112R. The fixation portion 112R is formed in a member (not illustrated), which is mounted in the rear side plate 92R. For example, the fixation portion 112R is formed to have a projection shape. The torsion spring 108R urges the rear side lever member 104R and the like to be rotated in the direction indicated by the arrow f. One end portion of the torsion spring 108F is coupled to the front side lever member 104F and another end portion thereof is fixed to a fixation portion 112F (not illustrated). The fixation portion 112F is formed in a member (not illustrated), which is mounted in the front side plate 92F. For example, the fixation portion 112F is formed to have a projection shape. The torsion spring 108F urges the front side lever member 104F and the like to be rotated in the direction indicated by the arrow f.

One end portion of the coil spring 110R is coupled to the rear side lever member 104R and another end portion thereof is fixed to the rear sideplate 92R. The coil spring 110R urges the rear side lever member 104R and the like to be rotated in the direction indicated by the arrow f. One end portion of the coil spring 110F is coupled to the front side lever member 104F and another end portion thereof is fixed to the front side plate 92F. The coil spring 110F urges the front side lever member 104F and the like to be rotated in the direction indicated by the arrow f.

At least one of a set of the torsion spring 108R and the torsion spring 108F and a set of the coil spring 110R and the coil spring 110F urges the rear side lever member 104R, the front side lever member 104F, the belt support unit 100, and the fixing belt 54 to be integrally rotated in the direction indicated by the arrow f illustrated in FIG. 3. Thus, the fixing belt 54 is pushed to the fixing roll 52.

FIG. 2 is a plan view illustrating the fixing device 18. In order to indicate a positional relationship between the fixing device 18 and the other members when the fixing device 18 is mounted in the image forming apparatus body 12 (see FIG. 1), in FIG. 2, a rear side cam member 114R (which will be described later), a front side cam member 114F (which will be described later), and the image forming apparatus body 12 are indicated by imaginary lines (using two-dot chain lines). The rear side cam member 114R is a member provided in the changing mechanism 84. The front side cam member 114F is similarly a member provided in the changing mechanism 84.

Figure 4:
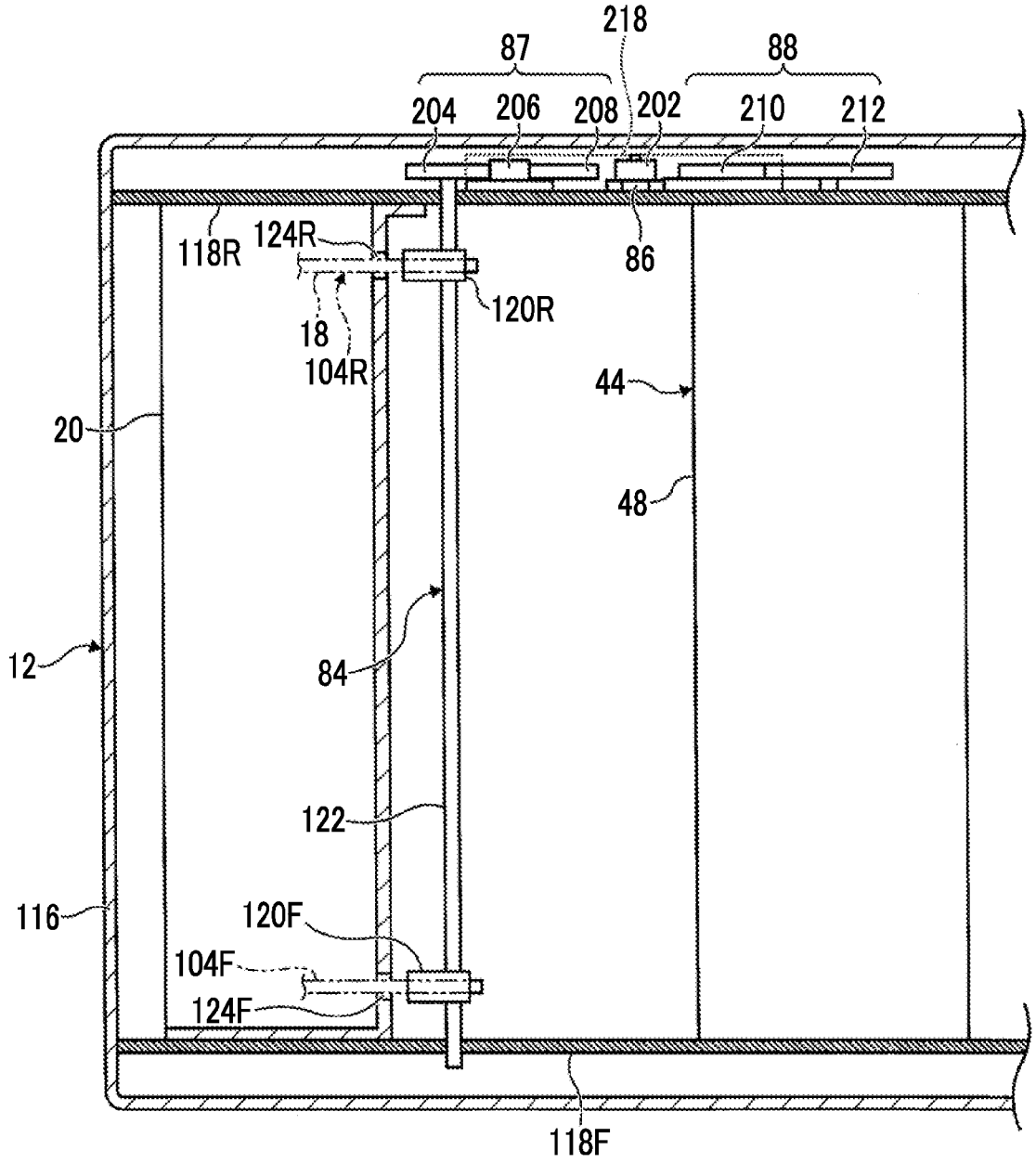
FIG. 4 is a plan view illustrating a positional relationship between the fixing device and a toner replenishing device of the image forming apparatus illustrated in FIG. 1.

FIG. 4 illustrates an A-A section of the image forming apparatus 10 in FIG. 1 in a state where the fixing device 18 is detached from the image forming apparatus body 12. In order to indicate a positional relationship between the changing mechanism 84 and the fixing device 18, in FIG. 4, a portion of the fixing device 18 is indicated by an imaginary line (two-dot chain line).

As illustrated in FIG. 4, the image forming apparatus body 12 includes an exterior cover portion 116 that forms an outer frame of the image forming apparatus 10 and is manufactured, for example, by molding of a resin, or the like. The image forming apparatus body 12 includes a rear side frame portion 118R and a front side frame portion 118F. The rear side frame portion 118R is disposed on the rear side in a space surrounded by the exterior cover portion 116 and is formed of, for example, metal. The front side frame portion 118F is disposed on the front side in the space surrounded by the exterior cover portion 116 and is formed of, for example, metal. The above-described tie-plate 20 is fixed to the rear side frame portion 118R and the front side frame portion 118F and thus is supported by the rear side frame portion 118R and the front side frame portion 118F.

As illustrated in FIG. 4, the changing mechanism 84 includes a rear side cam member 120R positioned on the rear side in the image forming apparatus body 12, and a front side cam member 120F positioned on the front side in the image forming apparatus body 12. The rear side cam member 120R and the front side cam member 120F are fixed to the coupling shaft 122, and are coupled to each other by the coupling shaft 122.

A position at which the rear side cam member 120R is fixed to the coupling shaft 122 is determined so as to allow the rear side cam member 120R and the rear side lever member 104R to come into contact with each other. A position at which the front side cam member 120F is fixed to the coupling shaft 122 is determined so as to allow the front side cam member 120F and the front side lever member 104F to come into contact with each other.

The coupling shaft 122 is supported so as to allow the rear end portion side thereof to be rotated in the rear side frame portion 118R and is supported so as to allow the front end portion side thereof to be rotated in the front side frame portion 118F. Thus, the rear side cam member 120R, the front side cam member 120F, and the coupling shaft 122 may be rotated in the image forming apparatus body 12 in a direction indicated by an arrow i illustrated in FIG. 5.

The changing mechanism 84 formed by the rear side cam member 120R and the front side cam member 120F is disposed between the tie-plate 20 and the toner replenishing device 44, as illustrated in FIG. 4. The first driving transmission mechanism 87, the motor 86, the swing gear 202, and the second driving transmission mechanism 88 (which will be described later) are disposed between the tie-plate 20 and the toner replenishing device 44, and are disposed on the outside of the rear side frame portion 118R in the image forming apparatus body 12.

The motor 86 is attached to a frame 218 of the image forming apparatus body 12. The motor 86 is coupled to the coupling shaft 122 through the first driving transmission mechanism 87. The motor 86 transmits a driving force and thus, rotates integrally with the rear side cam member 120R, the front side cam member 120F, and the coupling shaft 122 in the image forming apparatus body 12.

A rear side opening portion 124R is formed at a position on the rear side of the tie-plate 20, and a front side opening portion 124F is formed at a position on the front side of the tie-plate 20. The rear side lever member 104R is disposed so as to pass through the rear side opening portion 124R and to protrude toward the changing mechanism 84 side of the tie-plate 20 from the fixing device 18 side of the tie-plate 20. The front side lever member 104F is disposed so as to pass through the front side opening portion 124F and to protrude toward the changing mechanism 84 side of the tie-plate 20 from the fixing device 18 side of the tie-plate 20.

Figure 5:
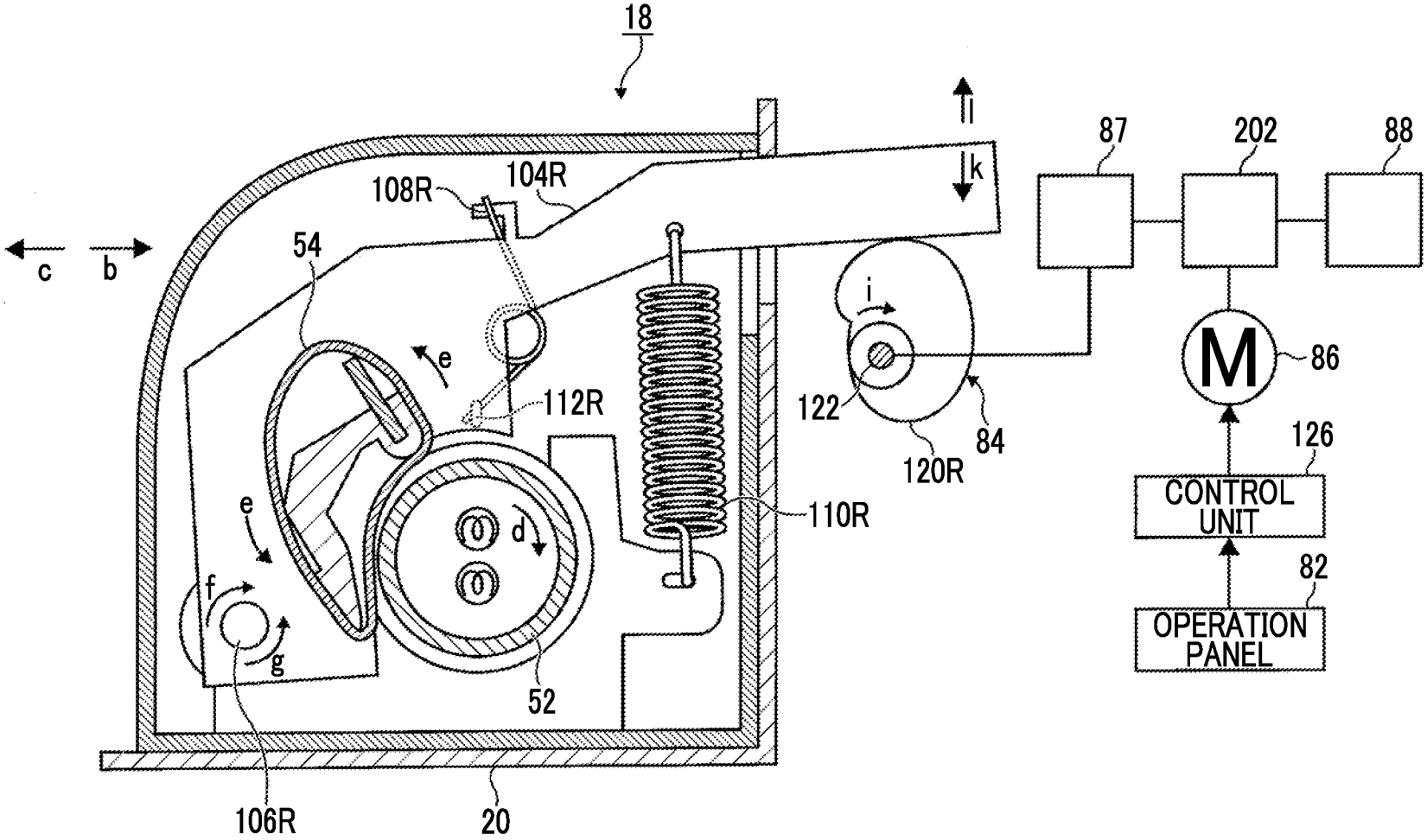
FIG. 5 is a diagram illustrating a configuration and an operation of a changing mechanism provided in the image forming apparatus illustrated in FIG. 1.

FIG. 5 illustrates a configuration and an operation of the changing mechanism 84. The changing mechanism 84 is operated based on an input and the like from the operation panel 82, for example, by the control unit 126 controlling the motor 86.

The motor 86 rotates under a control of the control unit 126. The motor 86 is coupled to the first driving transmission mechanism 87 by an action of the swing gear 202, and rotates the rear side cam member 120R and the front side cam member 120F in the direction indicated by the arrow i illustrated in FIG. 5. Rotation of the rear side cam member 120R and the front side cam member 120F causes right end sides of the rear side lever member 104R and the front side lever member 104F to be moved in a direction indicated by an arrow k illustrated in FIG. 5.

Here, the direction indicated by the arrow k and a direction indicated by an arrow 1 in which the changing mechanism 84 moves the right end portion side of the rear side lever member 104R and the right end portion side of the front side lever member 104F intersect with the direction indicated by the arrow b and the direction indicated by the arrow c (also see FIG. 1) in which the fixing device 18 is attached to and detached from the image forming apparatus body 12.

Figure 6A:
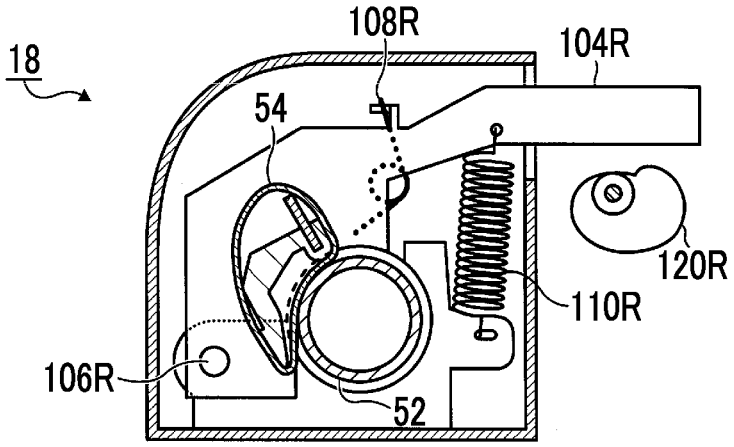
FIGS. 6A to 6C are diagrams illustrating the operation of the changing mechanism provided in the image forming apparatus illustrated in FIG. 1.
Figure 6B:
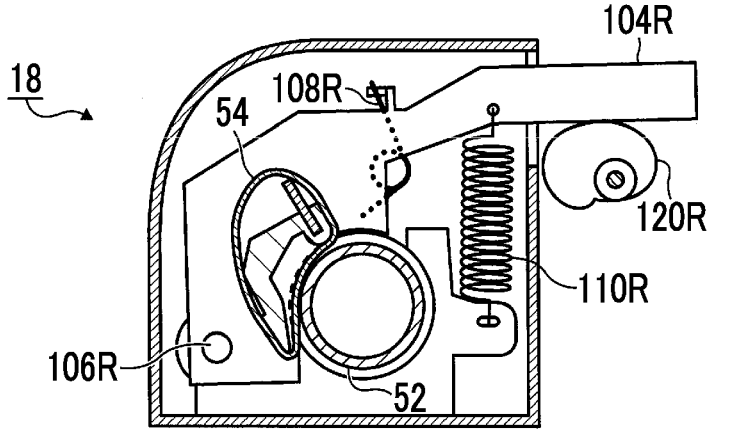
Figure 6C:
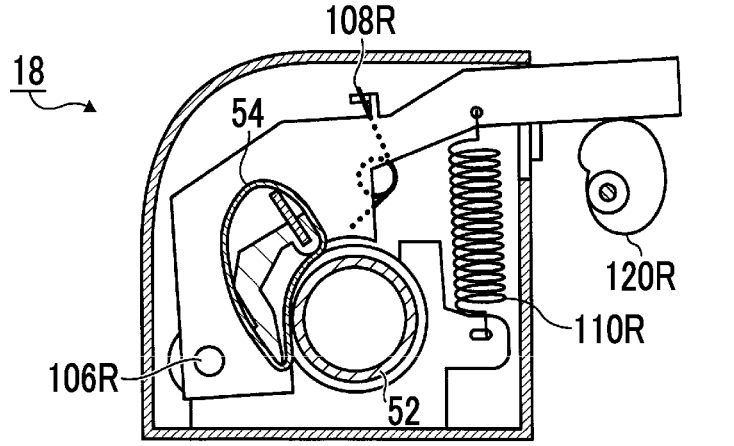

FIGS. 6A to 6C illustrate the operation of the changing mechanism 84. FIG. 6A illustrates the fixing device 18 when a developer image is fixed to plain paper. FIG. 6B illustrates the fixing device 18 when a developer image is fixed to an envelope. FIG. 6C illustrates the fixing device 18 in a state where the force for causing the fixing roll 52 and the fixing belt 54 to push each other is released.

FIGS. 6A to 6C are different from each other in position of the rear side lever member 104R. The rear side lever member 104R is moved by an action of the rear side cam member 120R which receives a driving force transmitted from the motor 86, as described above, and is rotated. In FIGS. 6A to 6C, the front side lever member 104F is not illustrated. However, the front side lever member 104F is integrated with the rear side lever member 104R and is moved similarly to a rear side lever.

In the state illustrated in FIG. 6A, the rear side cam member 120R does not contact with the rear side lever member 104R. The fixing belt 54 is pushed to the fixing roll 52 by both actions of the set of the torsion spring 108R and the torsion spring 108F (not illustrated) and the set of the coil spring 110R and the coil spring 110F (not illustrated).

In the state illustrated in FIG. 6B, an action of the rear side cam member 120R causes the rear side lever member 104R to be moved from a position illustrated in FIG. 6A in the direction indicated by the arrow g and the arrow 1. The front side lever member 104F is also moved similarly to the rear side lever member 104R. In the state illustrated in FIG. 6B, the force for causing the coil spring 110R to push the fixing belt 54 to the fixing roll 52 is released by movement of the rear side lever member 104R, and the force for causing the coil spring 110F to push the fixing belt 54 to the fixing roll 52 is released by movement of the front side lever member 104F.

In the state illustrated in FIG. 6B, the fixing belt 54 is pushed to the fixing roll 52 only by the torsion spring 108R and the torsion spring 108F. Thus, in the state illustrated in FIG. 6B, the force for pushing the fixing belt 54 to the fixing roll 52 is smaller than that in the state illustrated in FIG. 6A.

In the state illustrated in FIG. 6C, the action of the rear side cam member 120R causes the rear side lever member 104R to be further moved from a position illustrated in FIG. 6C in the direction indicated by the arrow g and the arrow 1. The front side lever member 104F is also moved similarly to the rear side lever member 104R. In the state illustrated in FIG. 6C, the force for causing the torsion spring 108R to push the fixing belt 54 to the fixing roll 52 is released by movement of the rear side lever member 104R, and the force for causing the torsion spring 108F to push the fixing belt 54 to the fixing roll 52 is released by movement of the front side lever member 104F.

Thus, in the state illustrated in FIG. 6C, either of the set of the torsion spring 108R and the torsion spring 108F and the set of the coil spring 110R and the coil spring 110F does not push the fixing belt 54 to the fixing roll 52. For convenience of illustration, FIG. 6C illustrates that the fixing belt 54 and the fixing roll 52 contact with each other. However, in a state where the force for pushing the fixing roll 52 and the fixing belt 54 to each other is released, it is desirable that the fixing roll 52 and the fixing belt 54 do not contact with each other.

Figure 7:
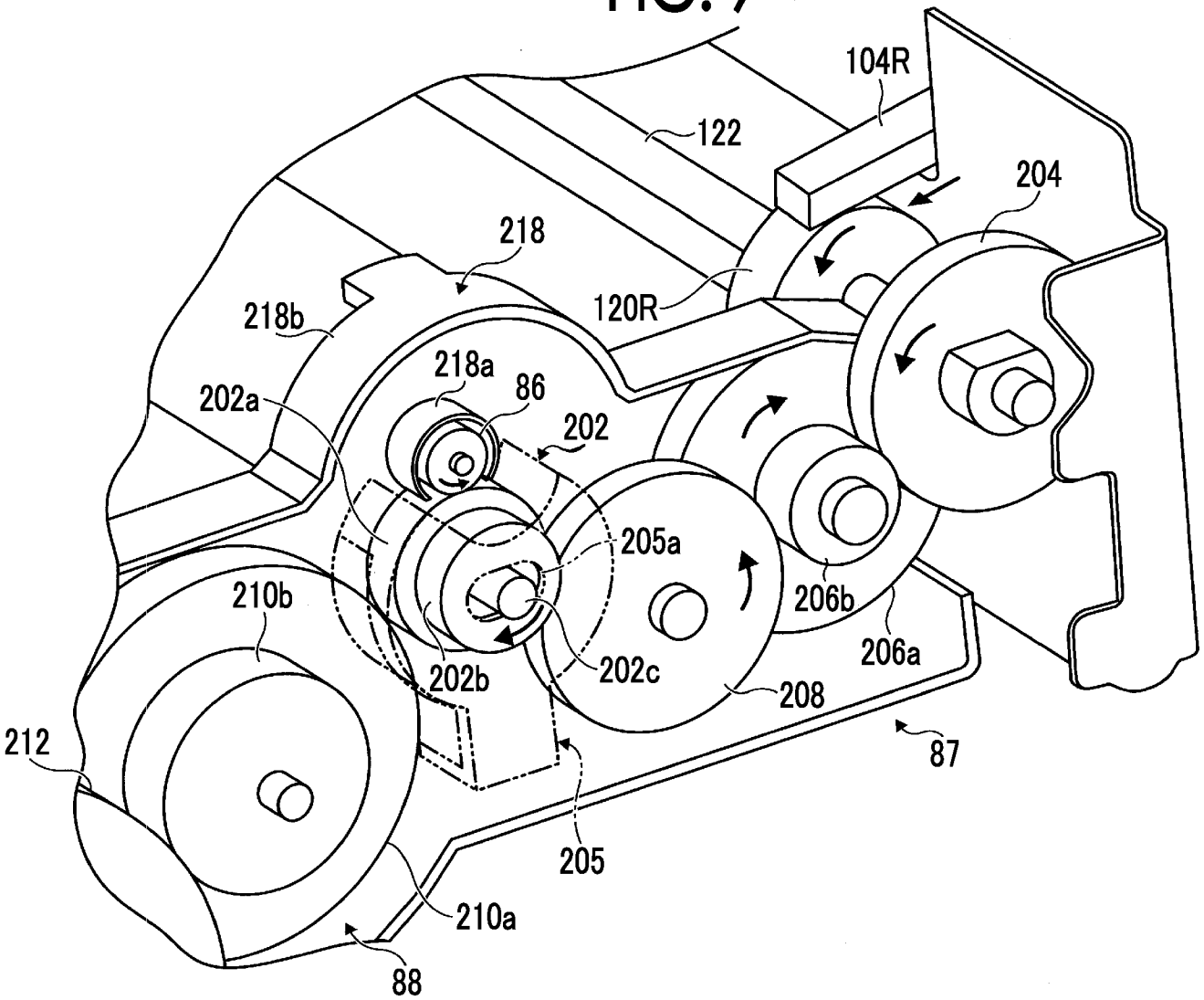
FIG. 7 is a perspective view illustrating a swing gear provided in the image forming apparatus illustrated in FIG. 1.
Figure 8:
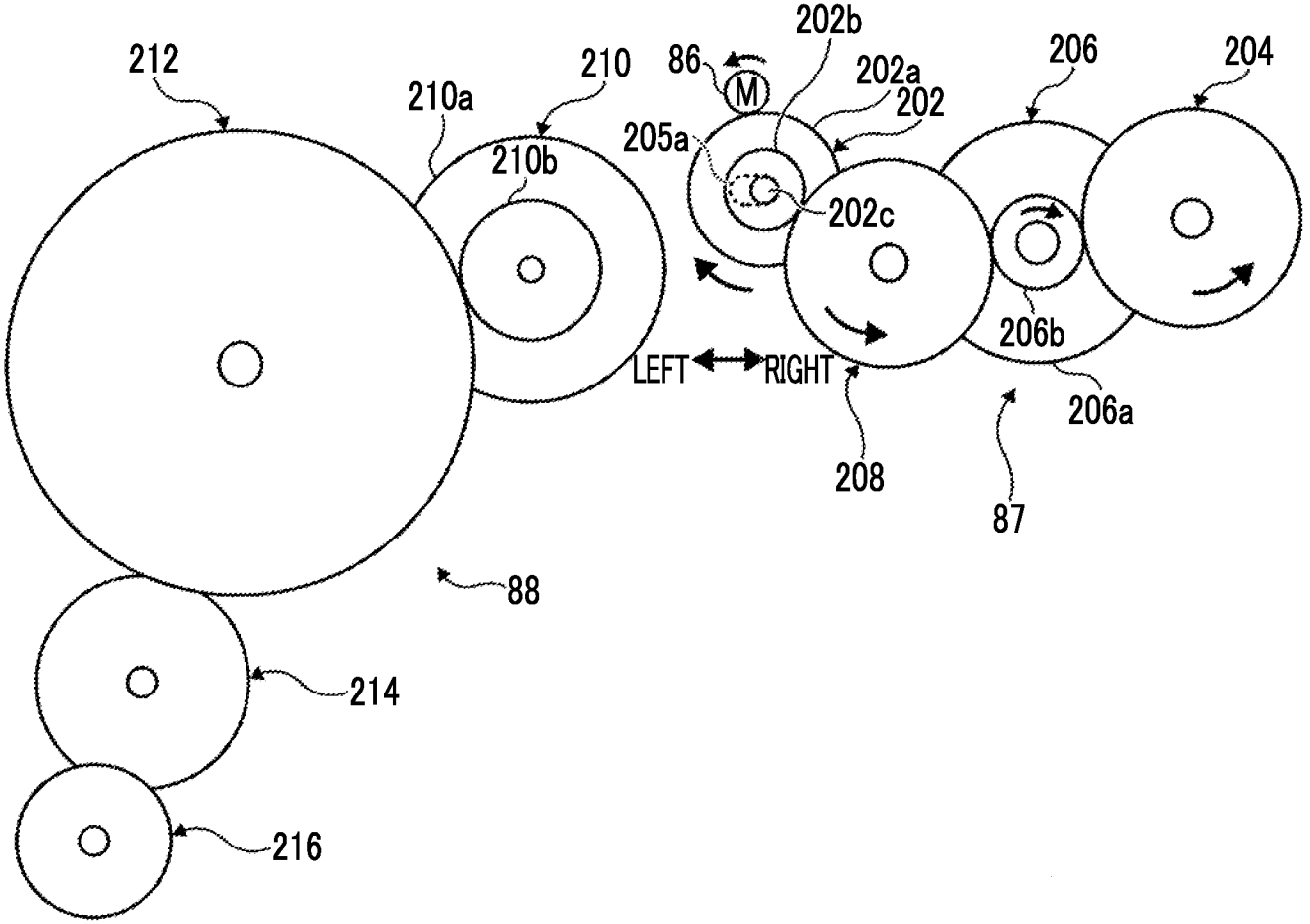
FIG. 8 is a plan view illustrating a relationship between the swing gear illustrated in FIG. 7 and a driving transmission mechanism.

FIG. 7 is a perspective view illustrating the surroundings of the swing gear 202. FIG. 8 is a plan view illustrating a relationship among the swing gear 202, the first driving transmission mechanism 87, and the second driving transmission mechanism 88.

The swing gear 202 is disposed between the first driving transmission mechanism 87 which transmits a driving force to the above-described changing mechanism 84, and the second driving transmission mechanism 88 which transmits a driving force to the toner replenishing device 44. That is, the swing gear 202 switches coupling between the first driving transmission mechanism 87 and the second driving transmission mechanism 88, and thus transmits the driving force of the motor 86.

The swing gear 202 is a gear formed from a large diameter portion 202*a* and a small diameter portion 202*b*. The large diameter portion 202*a* is coupled to the motor 86 which is a driving source. A support portion 202*c* is arranged at the center of the swing gear 202.

The first driving transmission mechanism 87 is configured with a first gear 204, a second gear 206 coupled to the first gear 204, and a third gear 208 coupled to the second gear 206. The second gear 206 is configured by a large diameter portion 206*a* and a small diameter portion 206*b*. The first gear 204 and the third gear 208 are coupled to the small diameter portion 206*b* of the second gear 206.

The first gear 204 is provided so as to have the same shaft as the coupling shaft 122. The rear side cam member 120R is rotated by rotation of the first gear 204. The first gear 204 is rotated by rotation of the rear side cam member 120R.

The second driving transmission mechanism 88 is configured by a fourth gear 210, a fifth gear 212 coupled to a small diameter portion 210*b*, a sixth gear 214 coupled to the fifth gear 212, and a seventh gear 216 couple to the sixth gear 214. The fourth gear 210 is configured with a large diameter portion 210*a* and the small diameter portion 210*b*.

The fifth gear 212 is provided so as to have the same axis as the toner replenishing device 44. The toner transporting member in the toner replenishing device 44 is driven by rotation of the fifth gear 212. The toner transporting member arranged in the transporting path 50 is driven by rotation of the seventh gear 216.

The swing gear 202 is covered with a cover 205. An elliptic hole 205*a* which has an elliptic shape and movably supports the support portion 202*c* is formed in the cover 205. The cover 205 is formed to cover the swing gear 202 in a state where a coupling portion to the third gear 208 and a coupling portion to the fourth gear 210 are opened. The swing gear 202 is moved right and left in FIG. 8 with being coupled to the motor 86, and thus the small diameter portion 202*b* of the swing gear 202 is coupled to the third gear 208 or the large diameter portion 202*a* of the swing gear 202 is coupled to the fourth gear 210.

The motor 86, the second gear 206, the third gear 208, the swing gear 202, and the fourth gear 210 are attached to the frame 218 and the cover 205 is attached to the frame 218 so as to cover the swing gear 202. The frame 218 includes a motor protective portion 218*a* and a cam protective portion 218*b*. The motor protective portion 218*a* protects the surroundings of the motor 86. The cam protective portion 218*b* is formed around the frame 218 so as to cover the teeth of each of the gears.

Figure 9A:
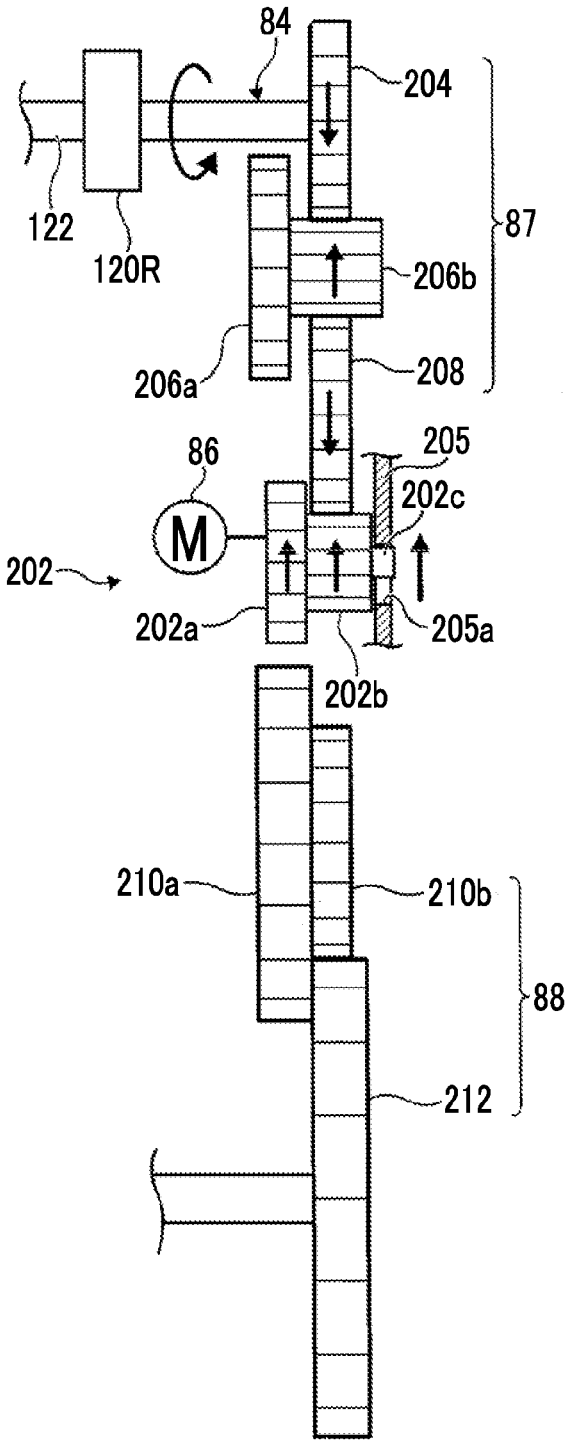
FIGS. 9A and 9B are diagrams illustrating an operation of the swing gear illustrated in FIG. 7.
Figure 9B:
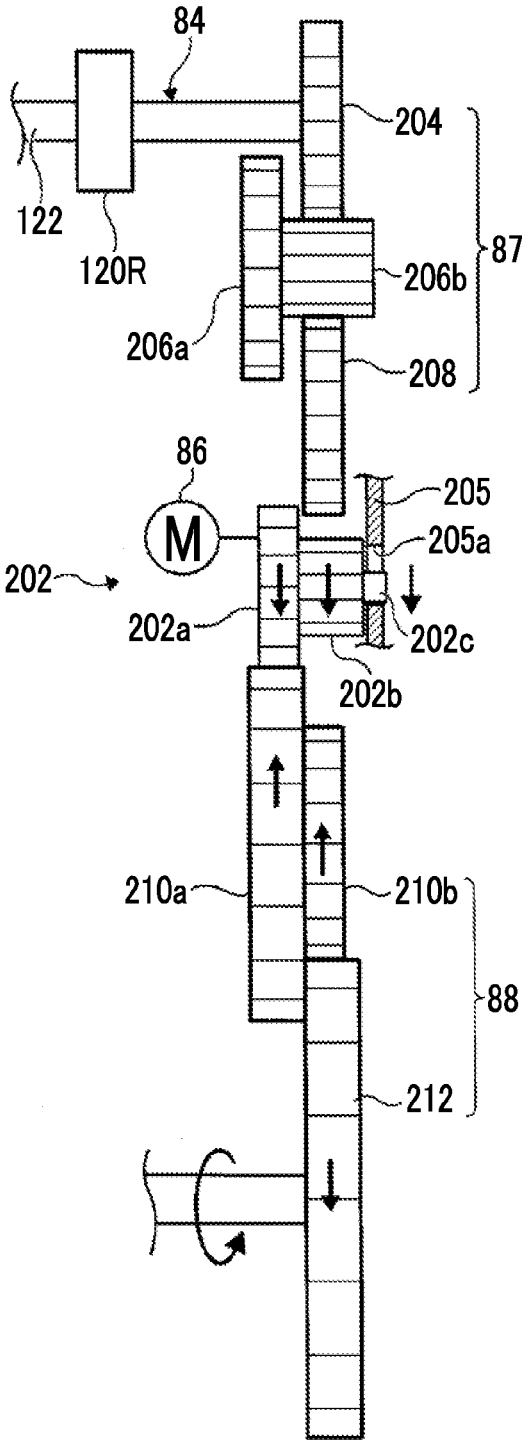

FIGS. 9A and 9B illustrate how the swing gear 202 switches a coupling to the motor 86 between the first driving transmission mechanism 87 and the second driving transmission mechanism 88.

As illustrated in FIG. 9A, the motor 86 is rotated counterclockwise and thus, the support portion 202*c* of the swing gear 202 is moved to the first driving transmission mechanism 87 side (fixing device 18 side) in the elliptic hole 205*a* and the small diameter portion 202*b* of the swing gear 202 is coupled to the third gear 208. The driving force of the motor 86 is transmitted to the changing mechanism 84 through the first driving transmission mechanism 87.

As illustrated in FIG. 9B, the motor 86 is rotated clockwise and thus, the support portion 202*c* of the swing gear 202 is moved to the second driving transmission mechanism 88 side (toner replenishing device 44 side) in the elliptic hole 205*a*, and the coupling between the swing gear 202 and the third gear 208 is released. The large diameter portion 202*a* of the swing gear 202 is coupled to the fourth gear 210 (large diameter portion 210*a*) and the driving force of the motor 86 is transmitted to the toner replenishing device 44 through the second driving transmission mechanism 88.

Figure 10:
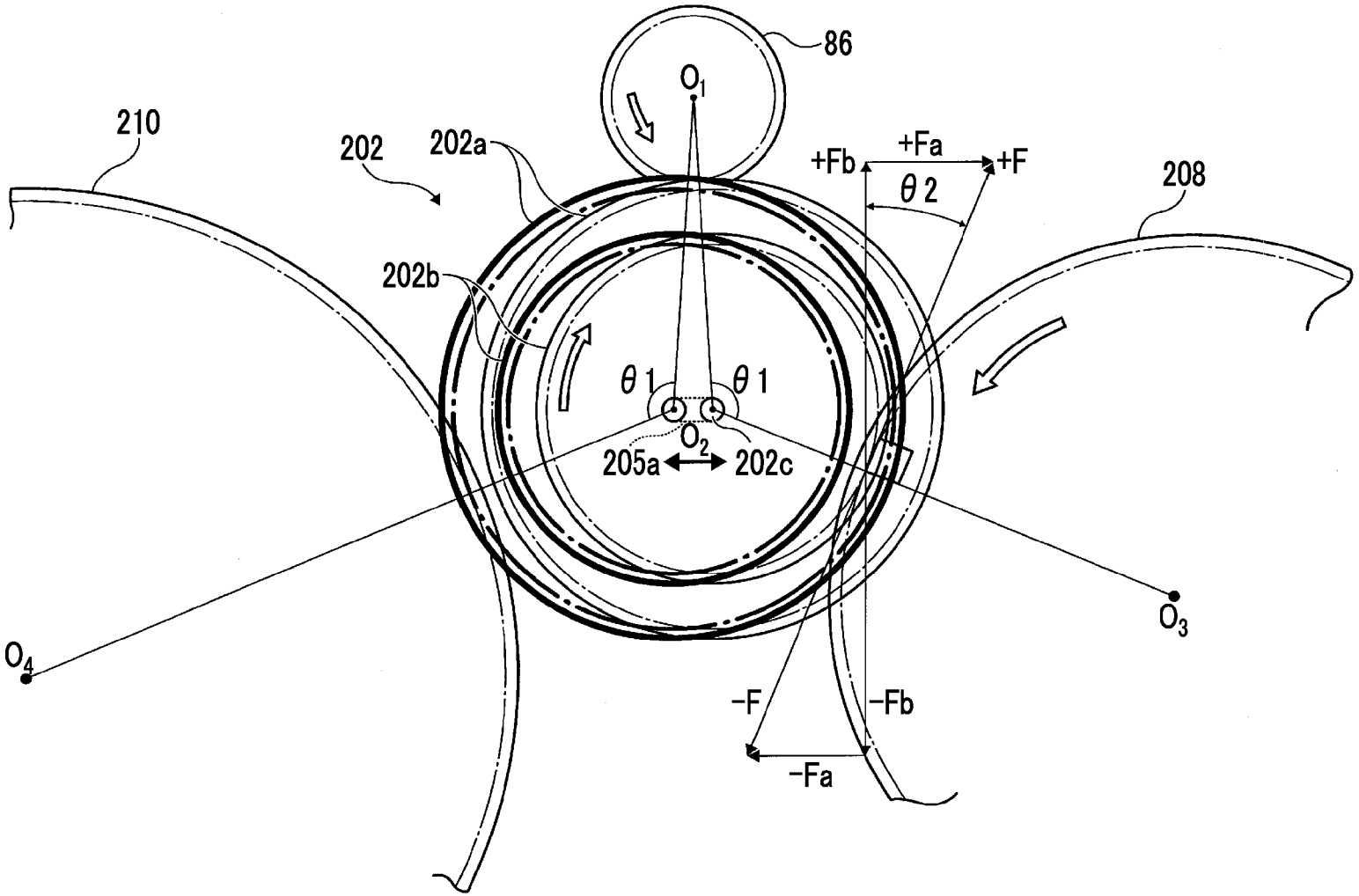
FIG. 10 is a diagram of a mechanism illustrating a positional relationship among a motor, the swing gear, and the respective gears.

FIG. 10 illustrates a diagram of a mechanism of the motor 86, the swing gear 202, the third gear 208, and the fourth gear 210.

Counterclockwise rotation of the motor 86 causes the small diameter portion 202*b* (fine line in FIG. 10) of the swing gear 202 to be coupled to the third gear 208. At this time, a force +F in a pitch circumferential direction is applied to the swing gear 202 at a coupling portion of the swing gear 202 and the third gear 208. An action of a component force +Fa of the force +F in the pitch circumferential direction causes the shaft center $O_2$ (support portion 202*c*) of the swing gear 202 to be moved to the third gear 208 side and a coupling between the swing gear 202 and the third gear 208 is held during an operation.

As illustrated in FIG. 7, when the fixing device 18 is mounted in the image forming apparatus body 12, the rear side lever member 104R is inserted in a direction indicated by an arrow and the rear side cam member 120R is rotated counterclockwise. The third gear 208 is rotated counterclockwise through the first gear 204 and the second gear 206 and thus, a force −F in the pitch circumferential direction is applied to the swing gear 202. An action of a component force −Fa of the force −F in the pitch circumferential direction causes the force to be applied in a direction in which the shaft center $O_2$ (support portion 202*c*) of the swing gear 202 is separated from the third gear 208, the coupling between the swing gear 202 and the third gear 208 is released, and a coupling to the motor 86 is released.

That is, in this exemplary embodiment, the rotation direction of the rear side cam member 120R which is operated by the changing mechanism 84 is equal to the rotation direction of the rear side cam member 120R when the rear side cam member 120R and the rear side lever member 104R come into contact with each other in the process of the fixing device 18 being mounted.

Here, the motor 86, the swing gear 202, the third gear 208, and the fourth gear 210 are disposed at such positions that an internal angle θ1 obtained by connecting a shaft center $O_1$ of the motor 86, a shaft center $O_2$ (support portion 202*c*) of the swing gear 202, and a shaft center $O_3$ of the third gear 208 is greater than 110°. Similarly, the motor 86, the swing gear 202, and the fourth gear 210 are disposed at such positions that an internal angle θ1 obtained by connecting the shaft center $O_1$ of the motor 86, the shaft center $O_2$ (support portion 202*c*) of the swing gear 202, and the shaft center $O_4$ of the fourth gear 210 is greater than 110°.

That is, the driving switching mechanism 202 and each of the gears are disposed at a position of an angle to the driving source (motor 86) which is greater than 110° obtained by adding 20° of a pressure angle θ2 of the gear and 90°. The driving switching mechanism 202 and each of the gears are moved to the first driving transmission mechanism 87 side or the second driving transmission mechanism 88 side in a state where the coupling between the motor 86 and the swing gear 202 is held.

According to the image forming apparatus 10 with the above-described configuration, replacement with the fixing device 18 causes the fixing roll 52 and the fixing belt 54 to be replaced or causes the toner replenishing device 44 to be replaced. However, the changing mechanism 84 or the motor 86 mounted in the image forming apparatus body 12 are not replaced along with the fixing device 18 or the toner replenishing device 44, and are also continuously used after a new fixing device 18 or a new toner replenishing device is mounted in the image forming apparatus body 12.

Even when a configuration in which the rear side lever member 104R comes into contact with the cam member 120R when the fixing device 18 is mounted in the image forming apparatus body 12 is made, the coupling between the third gear 208 and the motor 86 is released, and thus occurrence of a load during mounting of the fixing device, which occurs in a case where the coupling is not released is suppressed.

The press-contact adjustment mechanism of the fixing device 18 shares a driving source with the toner replenishing device 44 which is intermittently driven. Thus, deterioration of the productivity in image formation occurring when a driving source is used for a roll of the fixing device and a paper discharge roll is avoided.

In this exemplary embodiment, a configuration in which a driving transmission device 200 is provided only on the rear side cam member 120R side of the coupling shaft 122 is described. However, it is not limited thereto. The driving transmission device 200 may be provided on the front side cam member 120F side or on both of the rear side cam member 120R side and the front side cam member 120F side.

As described above, the exemplary embodiment of the invention may be applied to, for example, an image forming apparatus such as a copier, a facsimile device, and a printer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms a developer image on a recording medium;

a developer replenishing device that is detachable from an image forming apparatus body and replenishes a developer to the image forming unit;

a fixing device that is detachable from the image forming apparatus body, the fixing device including a first rotation member, and a second rotation member facing the first rotation member, the fixing device fixing the developer image formed by the image forming unit to the recording medium;

a press-contact adjustment mechanism that adjusts a press-contact state between the first rotation member and the second rotation member;

a first driving transmission mechanism that transmits a driving force from a diving source to the press-contact adjustment mechanism;

a second driving transmission mechanism that transmits a driving force from the driving source to the developer replenishing device; and a driving switching mechanism that couples the driving source to the first driving transmission mechanism or the second driving transmission mechanism, wherein the driving source, the driving switching mechanism, and a gear coupled to the driving switching mechanism are disposed at such positions that an internal angle obtained by connecting respective shaft centers thereof is greater than an angle obtained by adding a pressure angle of the gear and 90°.

2. The image forming apparatus according to claim 1, wherein the driving switching mechanism couples the driving source to the first driving transmission mechanism or the second driving transmission mechanism by switching a rotation direction of the driving source between a forward rotation and a reverse rotation.

3. The image forming apparatus according to claim 2, wherein the driving source is disposed between the press-contact adjustment mechanism and the developer replenishing device.

4. The image forming apparatus according to claim 1, wherein the driving source is disposed between the press-contact adjustment mechanism and the developer replenishing device.

5. The image forming apparatus according to claim 1, wherein a rotation direction in which the driving source rotates a gear train of the first driving transmission mechanism in a state where the driving source is coupled to the first driving transmission mechanism is the same as a rotation direction in which the gear train of the first driving transmission mechanism is rotation by bringing the fixing device into contact with the press-contact adjustment mechanism when the fixing device is mounted in the image forming apparatus body.

6. The image forming apparatus according to claim 1, wherein the driving switching mechanism further includes a support portion extending from a center of the driving switching mechanism through an elliptical hole of a switching mechanism cover arranged to cover the driving switching mechanism, the support portion being movably supported within the elliptical hole, the elliptical hole extending longitudinally in a transverse direction in which the driving switching mechanism is disposed between the first driving transmission mechanism and the second driving transmission mechanism.

* * * * *